US008015727B2

(12) United States Patent
Lee et al.

(10) Patent No.: US 8,015,727 B2
(45) Date of Patent: Sep. 13, 2011

(54) DRYER RACK

(75) Inventors: Dong Geun Lee, Gyeongsangnam-do (KR); Il Tak Han, Gyeonggi-do (KR); Tae Woo Kim, Yangsan-si (KR)

(73) Assignee: LG Electronics Inc., Seoul (KR)

( * ) Notice: Subject to any disclaimer, the term of this patent is extended or adjusted under 35 U.S.C. 154(b) by 719 days.

(21) Appl. No.: 10/958,655

(22) Filed: Oct. 6, 2004

(65) Prior Publication Data

US 2005/0102854 A1 May 19, 2005

(30) Foreign Application Priority Data

Nov. 11, 2003 (KR) ..... 10-2003-0079414
Dec. 10, 2003 (KR) ..... 10-2003-0089508

(51) Int. Cl.
*F26B 11/00* (2006.01)

(52) U.S. Cl. ..... 34/601; 34/602; 34/623; 34/610; 34/210; 34/218; 227/48; 227/76; 705/14; 156/111; 156/132; 414/788.2; 414/788; 73/38; 73/160; D32/209

(58) Field of Classification Search ..... 34/6–1, 34/602, 603, 620, 210, 218; 705/14; 414/788.2, 414/788; 227/48, 76; 73/38, 160; D32/209
See application file for complete search history.

(56) References Cited

U.S. PATENT DOCUMENTS 1,332,495 A * 3/1920 Graham ..... 56/1
1,543,153 A * 6/1925 Day ..... 156/365
1,575,723 A * 3/1926 Smith et al. ..... 53/209
RE16,352 E * 5/1926 Ronning et al. ..... 172/279
1,633,350 A * 6/1927 Russ ..... 53/154
1,743,398 A * 1/1930 Rosener ..... 227/48
RE18,341 E * 1/1932 Smith et al. ..... 53/209
1,874,670 A * 8/1932 Walker et al. ..... 227/76
1,894,201 A * 1/1933 Salomon ..... 65/88
1,939,810 A * 12/1933 Green ..... 425/107
1,953,288 A * 4/1934 Caton ..... 118/58
1,961,661 A * 6/1934 Fuller ..... 53/466
1,966,333 A * 7/1934 Cherry et al. ..... 493/27
1,981,974 A * 11/1934 Vernimb ..... 493/373
1,993,577 A * 3/1935 Von Pein ..... 177/38
2,016,029 A * 10/1935 Vassakos ..... 396/2
2,039,776 A * 5/1936 Caton ..... 427/188
2,107,825 A * 2/1938 Humphreys ..... 378/172
2,109,505 A * 3/1938 Rue et al. ..... 53/49
2,136,880 A * 11/1938 Honigman ..... 198/465.3
2,188,358 A * 1/1940 Kilmer ..... 140/6
2,258,960 A * 10/1941 Rymal ..... 211/70.4

(Continued)

FOREIGN PATENT DOCUMENTS

CH 611416 A * 5/1979

(Continued)

*Primary Examiner* — Stephen M. Gravini
(74) *Attorney, Agent, or Firm* — McKenna Long & Aldridge LLP

(57) ABSTRACT

A dryer rack for use with an apparatus for drying an object inside a drum is disclosed, wherein the dryer rack includes a platform for having an upper surface for supporting the object. The platform may include at least one grip for loading and unloading the dryer rack into an interior space of the drum. The at least one grip is flush with the upper surface of the platform. The at least one grip is formed in a forward portion of the platform, to be near an access point of the drum.

34 Claims, 5 Drawing Sheets

U.S. PATENT DOCUMENTS

| | | | | | |
|---|---|---|---|---|---|
| 2,288,772 | A | * | 7/1942 | Baker et al. | 271/69 |
| 2,301,067 | A | * | 11/1942 | Morgan | 493/279 |
| 2,355,697 | A | * | 8/1944 | Belluche | 271/69 |
| 2,370,276 | A | * | 2/1945 | Warren | 141/174 |
| 2,410,673 | A | * | 11/1946 | Naumann | 264/188 |
| 2,448,842 | A | * | 9/1948 | Tholstrup | 400/61 |
| 2,542,073 | A | * | 2/1951 | Aberle | 101/144 |
| 2,562,525 | A | * | 7/1951 | Cary | 250/339.07 |
| 2,629,323 | A | * | 2/1953 | Baumgardner et al. | 101/232 |
| 2,632,603 | A | * | 3/1953 | Hunsdorf | 242/433.1 |
| 2,637,526 | A | * | 5/1953 | Hoge et al. | 254/301 |
| 2,659,556 | A | * | 11/1953 | Doblhoff | 244/136 |
| 2,671,495 | A | * | 3/1954 | Iredell et al. | 156/361 |
| 2,681,743 | A | * | 6/1954 | Phin et al. | 156/357 |
| 2,688,163 | A | * | 9/1954 | Burger et al. | 28/121 |
| 2,712,141 | A | * | 7/1955 | Sieb | 412/29 |
| 2,740,138 | A | * | 4/1956 | Quinn | 12/1 W |
| 2,783,509 | A | * | 3/1957 | Miller | 164/181 |
| 2,883,815 | A | * | 4/1959 | Maitino | 53/239 |
| 2,913,155 | A | * | 11/1959 | Maxwell et al. | 223/37 |
| 2,923,396 | A | * | 2/1960 | Hait et al. | 198/386 |
| 2,933,174 | A | * | 4/1960 | Hait et al. | 198/386 |
| 2,949,136 | A | * | 8/1960 | White | 140/88 |
| 2,955,717 | A | * | 10/1960 | Segur et al. | 414/791.8 |
| 2,958,431 | A | * | 11/1960 | Curtenius | 414/793.8 |
| 3,025,643 | A | * | 3/1962 | Thompson | 451/151 |
| 3,039,233 | A | * | 6/1962 | Holmes | 52/749.14 |
| 3,086,768 | A | * | 4/1963 | Lach | 493/415 |
| 3,087,405 | A | * | 4/1963 | Sachs et al. | 396/578 |
| 3,097,461 | A | * | 7/1963 | Avril | 53/136.5 |
| 3,103,243 | A | * | 9/1963 | Senior | 72/309 |
| 3,110,278 | A | * | 11/1963 | Leader | 228/5.1 |
| 3,150,740 | A | * | 9/1964 | Rubeli | 182/41 |
| 3,215,231 | A | * | 11/1965 | Lodige | 188/189 |
| 3,218,950 | A | * | 11/1965 | Liedl et al. | 355/85 |
| 3,221,967 | A | * | 12/1965 | Mackenzie et al. | 227/28 |
| 3,228,293 | A | * | 1/1966 | Kane et al. | 89/1.8 |
| 3,231,158 | A | * | 1/1966 | Rossak | 223/76 |
| 3,232,633 | A | * | 2/1966 | Feher | 280/43.23 |
| 3,270,628 | A | * | 9/1966 | Clem | 493/283 |
| 3,281,304 | A | * | 10/1966 | Black et al. | 156/351 |
| 3,305,907 | A | * | 2/1967 | Baker | 425/99 |
| 3,311,140 | A | * | 3/1967 | Hughes | 141/144 |
| 3,316,659 | A | * | 5/1967 | Lauck | 34/600 |
| 3,318,745 | A | * | 5/1967 | Black et al. | 156/111 |
| 3,322,595 | A | * | 5/1967 | Black et al. | 156/351 |
| 3,323,968 | A | * | 6/1967 | Heide et al. | 156/350 |
| 3,331,506 | A | * | 7/1967 | Smith et al. | 209/560 |
| 3,347,279 | A | * | 10/1967 | Malchair | 139/457 |
| 3,348,400 | A | * | 10/1967 | Korf | 72/161 |
| 3,355,346 | A | * | 11/1967 | Black et al. | 156/396 |
| 3,375,151 | A | * | 3/1968 | Black et al. | 156/132 |
| 3,520,726 | A | * | 7/1970 | Gay | 134/63 |
| 3,545,166 | A | * | 12/1970 | Johnson et al. | 53/459 |
| 3,550,227 | A | * | 12/1970 | Miklos et al. | 445/67 |
| 3,590,760 | A | * | 7/1971 | Boyd et al. | 144/4.1 |
| 3,613,741 | A | * | 10/1971 | Ravella | 139/430 |
| 3,619,326 | A | * | 11/1971 | Burbidge | 156/384 |
| 3,655,040 | A | * | 4/1972 | Gay | 209/544 |
| 3,663,135 | A | * | 5/1972 | Schiesser | 425/73 |
| 3,675,815 | A | * | 7/1972 | Rehrig | 206/507 |
| 3,677,635 | A | * | 7/1972 | Van Auken et al. | 399/90 |
| 3,677,637 | A | * | 7/1972 | Van Auken et al. | 355/45 |
| 3,724,095 | A | * | 4/1973 | Laue et al. | 34/139 |
| 3,726,745 | A | * | 4/1973 | Gidge et al. | 156/510 |
| 3,728,819 | A | * | 4/1973 | Goldbach et al. | 49/216 |
| 3,779,160 | A | * | 12/1973 | Black et al. | 101/115 |
| 3,780,651 | A | * | 12/1973 | Black et al. | 101/115 |
| 3,780,652 | A | * | 12/1973 | Black et al. | 101/124 |
| 3,783,059 | A | * | 1/1974 | Black et al. | 156/64 |
| 3,840,103 | A | * | 10/1974 | Willis | 194/210 |
| 3,879,784 | A | * | 4/1975 | Kummerman | 14/71.1 |
| 3,880,635 | A | * | 4/1975 | Jack et al. | 65/106 |
| 3,888,722 | A | * | 6/1975 | Blair et al. | 156/477.1 |
| 3,929,299 | A | * | 12/1975 | Walkington | 242/530 |
| 3,986,915 | A | * | 10/1976 | Farnam | 156/256 |
| 4,033,461 | A | * | 7/1977 | Nevai | 211/85.25 |
| 4,064,675 | A | * | 12/1977 | Stapp et al. | 53/54 |
| 4,239,565 | A | * | 12/1980 | Henley et al. | 156/126 |
| 4,243,081 | A | * | 1/1981 | Pritelli | 144/392 |
| 4,253,411 | A | * | 3/1981 | Shulzhenko et al. | 111/105 |
| 4,352,463 | A | * | 10/1982 | Baker | 239/663 |
| 4,355,511 | A | * | 10/1982 | Jones | 60/507 |
| 4,391,360 | A | * | 7/1983 | Minnetti | 198/412 |
| 4,413,583 | A | * | 11/1983 | Elling et al. | 114/350 |
| 4,597,352 | A | * | 7/1986 | Norminton | 114/254 |
| 4,625,961 | A | * | 12/1986 | Brand | 482/116 |
| 4,666,356 | A | * | 5/1987 | Newbury | 414/788.2 |
| 4,671,494 | A | * | 6/1987 | Makino et al. | 254/277 |
| 4,696,614 | A | * | 9/1987 | Moen | 414/788 |
| 4,800,104 | A | * | 1/1989 | Cruickshank | 427/230 |
| 4,867,819 | A | * | 9/1989 | Richardelli et al. | 156/92 |
| 4,878,452 | A | * | 11/1989 | Regan et al. | 114/293 |
| 4,883,578 | A | * | 11/1989 | Jowitt et al. | 204/625 |
| 4,908,959 | A | * | 3/1990 | Kretchman et al. | 34/609 |
| 4,941,401 | A | * | 7/1990 | Sarnoff et al. | 99/446 |
| 5,096,564 | A | * | 3/1992 | Jowitt et al. | 204/625 |
| 5,197,405 | A | * | 3/1993 | King | 114/344 |
| 5,271,250 | A | * | 12/1993 | Benito | 66/152 |
| 5,365,675 | A | * | 11/1994 | Shabram, Jr. | 34/109 |
| 5,540,778 | A | * | 7/1996 | Colligan et al. | 118/672 |
| 5,605,094 | A | * | 2/1997 | Besnier | 100/70 R |
| 5,642,601 | A | * | 7/1997 | Thompson et al. | 53/431 |
| 5,651,188 | A | * | 7/1997 | Swanson et al. | 34/82 |
| 5,651,235 | A | * | 7/1997 | Ashley et al. | 53/458 |
| 5,672,375 | A | * | 9/1997 | Colligan et al. | 427/2.31 |
| 5,804,107 | A | * | 9/1998 | Martin et al. | 264/1.36 |
| 5,845,593 | A | * | 12/1998 | Birkestrand | 114/39.11 |
| 5,892,142 | A | * | 4/1999 | Ghorashi et al. | 73/38 |
| 5,907,394 | A | * | 5/1999 | Ghorashi et al. | 356/73.1 |
| 5,921,848 | A | * | 7/1999 | Zang et al. | 451/57 |
| 5,943,907 | A | * | 8/1999 | Ghorashi et al. | 73/160 |
| 5,964,378 | A | * | 10/1999 | Sperry et al. | 222/145.2 |
| 5,996,848 | A | * | 12/1999 | Sperry et al. | 222/145.2 |
| 6,026,592 | A | * | 2/2000 | Herr | 34/446 |
| 6,039,899 | A | * | 3/2000 | Martin et al. | 264/1.36 |
| 6,098,454 | A | * | 8/2000 | Ghorashi et al. | 73/160 |
| 6,112,131 | A | * | 8/2000 | Ghorashi et al. | 700/142 |
| 6,199,720 | B1 | * | 3/2001 | Rudick et al. | 221/6 |
| 6,240,838 | B1 | * | 6/2001 | Backus et al. | 99/421 H |
| 6,311,740 | B1 | * | 11/2001 | Sperry et al. | 141/129 |
| 6,328,411 | B1 | * | 12/2001 | Taylor et al. | 347/29 |
| 6,379,206 | B1 | * | 4/2002 | Wallasch | 441/80 |
| 6,385,862 | B1 | * | 5/2002 | Vande Haar | 34/441 |
| 6,464,929 | B1 | * | 10/2002 | Groteke | 266/205 |
| 6,511,617 | B1 | * | 1/2003 | Martin et al. | 264/1.36 |
| 6,556,889 | B2 | * | 4/2003 | Rudick et al. | 700/244 |
| 6,581,698 | B1 | * | 6/2003 | Dirks | 175/52 |
| 6,582,037 | B1 | * | 6/2003 | Rudick et al. | 312/334.22 |
| 6,601,942 | B2 | * | 8/2003 | Taylor et al. | 347/29 |
| 6,604,017 | B1 | * | 8/2003 | Richardson et al. | 700/223 |
| 6,610,382 | B1 | * | 8/2003 | Kobe et al. | 428/119 |
| 6,783,317 | B2 | * | 8/2004 | Claeys | 414/788.1 |
| D496,506 | S | * | 9/2004 | Keeler et al. | D32/25 |
| 6,904,615 | B2 | * | 6/2005 | Kobe et al. | 2/161.8 |
| 7,220,365 | B2 | * | 5/2007 | Qu et al. | 252/70 |
| 7,270,293 | B1 | * | 9/2007 | Karoly | 242/598.3 |
| 7,287,731 | B2 | * | 10/2007 | Johnson | 248/183.3 |
| 7,661,391 | B2 | * | 2/2010 | Sia | 119/346 |
| 7,681,357 | B2 | * | 3/2010 | Dyas | 47/66.5 |
| 7,783,383 | B2 | * | 8/2010 | Eliuk et al. | 700/245 |
| 7,793,911 | B2 | * | 9/2010 | Fontana et al. | 248/694 |
| 7,823,845 | B2 | * | 11/2010 | Fontana et al. | 248/200.1 |
| 7,930,066 | B2 | * | 4/2011 | Eliuk et al. | 700/245 |
| 2001/0000609 | A1 | * | 5/2001 | Rudick et al. | 221/6 |
| 2002/0008727 | A1 | * | 1/2002 | Taylor et al. | 347/29 |
| 2002/0042234 | A1 | * | 4/2002 | Wallasch | 441/80 |
| 2002/0081748 | A1 | * | 6/2002 | Roberts et al. | 436/174 |
| 2003/0066638 | A1 | * | 4/2003 | Qu et al. | 165/186 |
| 2003/0100422 | A1 | * | 5/2003 | Claeys | 493/81 |
| 2003/0203155 | A1 | * | 10/2003 | Kobe et al. | 428/119 |
| 2003/0209642 | A1 | * | 11/2003 | Fontana et al. | 248/231.91 |
| 2004/0113033 | A1 | * | 6/2004 | Johnson | 248/183.3 |
| 2005/0046131 | A1 | * | 3/2005 | Gunderson | 280/47.27 |
| 2005/0080520 | A1 | * | 4/2005 | Kline et al. | 701/1 |
| 2005/0102854 | A1 | * | 5/2005 | Lee et al. | 34/602 |
| 2005/0139363 | A1 | * | 6/2005 | Thomas | 169/30 |

| | | | | |
|---|---|---|---|---|
| 2005/0167556 | A1 * | 8/2005 | Fontana et al. | 248/231.91 |
| 2005/0263658 | A1 * | 12/2005 | Fontana et al. | 248/231.91 |
| 2005/0281999 | A1 * | 12/2005 | Hofmann et al. | 428/304.4 |
| 2006/0070816 | A1 * | 4/2006 | Schroder | 187/222 |
| 2006/0180564 | A1 * | 8/2006 | Keppel | 212/330 |
| 2006/0206246 | A1 * | 9/2006 | Walker | 701/16 |
| 2006/0218862 | A1 * | 10/2006 | Dyas | 47/86 |
| 2006/0259195 | A1 * | 11/2006 | Eliuk et al. | 700/245 |
| 2007/0020059 | A1 * | 1/2007 | Rapeli | 410/24 |
| 2007/0135803 | A1 * | 6/2007 | Belson | 606/1 |
| 2007/0215061 | A1 * | 9/2007 | Sia | 119/329 |
| 2009/0031913 | A1 * | 2/2009 | Heaslip et al. | 104/63 |
| 2009/0293733 | A1 * | 12/2009 | Martin et al. | 99/280 |
| 2010/0132622 | A1 * | 6/2010 | Sia | 119/300 |
| 2010/0133046 | A1 * | 6/2010 | Allwardt et al. | 187/251 |
| 2010/0198392 | A1 * | 8/2010 | Eliuk et al. | 700/216 |
| 2010/0210745 | A1 * | 8/2010 | McDaniel et al. | 521/55 |
| 2010/0242360 | A1 * | 9/2010 | Dyas | 47/66.5 |
| 2010/0308563 | A1 * | 12/2010 | Martin | 280/652 |

FOREIGN PATENT DOCUMENTS

| | | | | |
|---|---|---|---|---|
| CH | 611416 | A5 * | 5/1979 | |
| DE | 3202869 | A1 * | 7/1983 | |
| DE | 3508096 | A1 * | 9/1986 | |
| DE | 3629145 | A1 * | 3/1988 | |
| DE | 3639133 | A1 * | 5/1988 | |
| DE | 4129896 | A1 * | 3/1992 | |
| DE | 4127319 | A1 * | 2/1993 | |
| DE | 19841600 | A1 * | 3/2000 | |
| EP | 177050 | A2 * | 4/1986 | |
| EP | 196581 | A2 * | 10/1986 | |
| EP | 385180 | A2 * | 9/1990 | |
| EP | 446529 | A2 * | 9/1991 | |
| EP | 476919 | A2 * | 3/1992 | |
| EP | 550225 | A2 * | 7/1993 | |
| EP | 616249 | A1 * | 9/1994 | |
| EP | 863103 | A2 * | 9/1998 | |
| EP | 1690973 | A1 * | 8/2006 | |
| EP | 1857585 | A1 * | 11/2007 | |
| FR | 2547359 | A1 * | 12/1984 | |
| FR | 2615428 | A1 * | 11/1988 | |
| FR | 2713617 | A1 * | 6/1995 | |
| FR | 2753680 | A1 * | 3/1998 | |
| GB | 2033530 | A * | 5/1980 | |
| GB | 2068133 | A * | 8/1981 | |
| GB | 2084377 | A * | 4/1982 | |
| GB | 2204897 | A * | 11/1988 | |
| JP | 54126044 | A * | 9/1979 | |
| JP | 54126045 | A * | 9/1979 | |
| JP | 54137349 | A * | 10/1979 | |
| JP | 54155056 | A * | 12/1979 | |
| JP | 01249097 | A * | 10/1989 | |
| JP | 02099096 | A * | 4/1990 | |
| JP | 02126900 | A * | 5/1990 | |
| JP | 03057490 | A * | 3/1991 | |
| JP | 06063292 | A * | 3/1994 | |
| JP | 06156613 | A * | 6/1994 | |
| JP | 06304642 | A * | 11/1994 | |
| JP | 09-220399 | | 8/1997 | |
| WO | WO 9916065 | A1 * | 4/1999 | |
| WO | WO 02061195 | A2 * | 8/2002 | |
| WO | WO 02061196 | A2 * | 8/2002 | |
| WO | WO 2006115386 | A1 * | 11/2006 | |
| WO | WO 2007068529 | A1 * | 6/2007 | |

* cited by examiner

DRYER RACK

This application claims the benefit of Korean Application No. P2003-079414, filed on Nov. 11, 2003, and No. P2003-089508, filed on Dec. 10, 2003, which are hereby incorporated by reference.

BACKGROUND OF THE INVENTION

1. Field of the Invention

The present invention relates to a dryer accessory, and more particularly, to a dryer rack used in a dryer or washing machine equipped with a drying function.

2. Discussion of the Related Art

Generally, a dryer or washing machine equipped with a drying function is an apparatus for drying objects such as a laundry and the like held in a drum by supplying hot air to the drum. And, a demand for such an apparatus is gradually raised lately.

A lifter is provided within the dryer or washing machine to enhance drying performance in general. The lifter and drum are individually manufactured, and the lifter is then installed on an inside of the drum via a locking member such as a screw and the like. Instead, a lifter can be proved by 'pressing' in a manner that a circumferential surface of a drum is pressed to protrude from an inside of the drum. In drying an object to be dried, the corresponding object held within a drum is lifted by a plurality of lifter protruding inward from an inside of a drum up to a predetermined height and then falls. The object is easily exposed to hot air supplied to the drum to be evenly dried, thereby enhancing drying efficiency. Thus, if using the dryer or washing machine equipped with the drying function, such a relatively light drying object as cloths and the like can be conveniently dried.

However, it is difficult to dry a relatively heavy drying object using a general dryer or washing machine equipped with the drying function. Since the heavy drying object lifted by the lifters gives a considerable shock to the drum when falling, loud noise is generated from the drum or the corresponding dryer or washing machine may be out of order.

SUMMARY OF THE INVENTION

Accordingly, the present invention is directed to a dryer rack that substantially obviates one or more of the problems due to limitations and disadvantages of the related art.

An object of the present invention, which as been devised to solve the foregoing problem, lies in providing a dryer rack, by which a relatively heavy drying object can be easily and safely dried.

Another object of the present invention is to provide a dryer rack, which can be easily attached to a drum of a dryer/washer to use.

A further object of the present invention is to provide a dryer rack, which can be stably and firmly loaded in a drum of a dryer/washer to use.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dryer rack for use with an apparatus for drying an object inside a drum, wherein the dryer rack includes a platform having an upper surface for supporting the object. The platform may include at least one grip for loading and unloading the dryer rack into a interior space of the drum. The at least one grip is flush with the upper surface of the platform. The at least one grip is formed in a forward portion of the platform, to be near an access point of the drum.

The at least one grip may include an opposing pair of openings formed in the platform, and a gripping surface formed on inner side surfaces on each opening. The gripping surface may be textured to facilitate gripping. And, the gripping surface may include a set of curved recesses corresponding to digits of a human hand. The gripping surfaces of the opposing pair of openings may be symmetrically arranged with respect to a centrally disposed handle.

The gripping surfaces of the opposing pair of openings are asymmetrically arranged with respect to a centrally disposed handle. Herein, the asymmetrical arrangement of the gripping surfaces provides for a thumb and four fingers, respectfully. The platform may include a pair of grips, symmetrically arranged about a central axis of the platform, for loading and unloading the dryer rack into an interior space of the drum. The pair of grips may be flushed with the upper surface of the platform. The pair of grips may also be formed in a forward portion of the platform, to be near an access point of the drum. And, the grips may be arranged at opposing angles for facilitating a two-handed grip when loading and unloading the dryer rack. Herein, the opposing angles may be between 10° and 20°.

The platform may include a tray, forming the upper surface between a forward end and a rearward end of the tray, a front support, connected to the forward end of the tray, to be supported by a first structure, and a rear support, connected to the rearward end of the tray, to be supported by a second structure, wherein the first and second structures respectively provide rotatable support to opposite ends of the drum. Herein, the plat form may include at least one grip for loading and unloading the dryer rack into an interior space of the drum. And, the at least grip may be flushed with the upper surface of the platform.

The front and rear supports may have lower surfaces for seating the dryer rack on the first and second structures. Herein, the lower surfaces of front and rear supports may be shaped to avoid interference with the drum if the drum is rotated while the dryer rack is loaded into an interior space of the drum. The platform may have a lattice structure.

In another aspect of the present invention, there if provided a dryer rack for use with an apparatus for drying an object inside a drum, wherein the dryer rack includes a tray having an upper surface for supporting the object between a forward end and a rearward end of the tray, a front support, connected to the forward end of the tray, having a first lower surface for receiving a first structure, and a rear support, connected to the rearward end of the tray, having a second lower surface for receiving a second structure, wherein the first and second structures respectively provide rotatable support to opposite ends of the drum.

The front support may rest atop a filter, installed forward of the drum, for filtering air expelled from the drum. The front support may include a pair of side extensions, connected to the forward end of the tray, for supporting the dryer rack on the filter, and an arch, stretching between the side extensions and extending downward, for being seated on an upper surface of the filter having a centrally formed recess, the arch having an arch projection for insertion into the recess of the filter.

The side extensions may be disposed forward of the tray. The rear support may include at least one leg, connected to the rearward end of the tray, for supporting the dryer rack on the second structure. The second structure may be a semicircle. Herein, the at least one leg has a curved lower surface for being seated on the semicircle of the second structure. And, the rear support may include at least two legs, connected to the rearward end of the tray, for supporting the dryer rack on the second structure, the at least two legs having opposingly curved surfaces for being respectively seated on a semicircle of the second structure.

The dryer rack may include at least one grip, formed in the upper surface of the tray, for loading and unloading the dryer rack into an interior space of the drum. The at least one grip may include an opposing pair of openings formed in the platform, and a gripping surface formed on inner sides surfaces on each opening. Herein, the griping surface may be textured to facilitate gripping. The gripping surface may include a set of curved recesses corresponding to digits of a human hand. The gripping surfaces of the opposing pair of openings may be symmetrically arranged with respect to a centrally disposed handle. Also, the gripping surfaces of the opposing pair of openings may be asymmetrically arranged with respect to a centrally disposed handle. The asymmetrical arrangement of the gripping surfaces provides for a thumb and four fingers, respectively.

In a further aspect of the present invention, there is provided a dryer rack for use with an apparatus for drying an object inside a drum, wherein the dryer rack includes a platform having an upper surface for supporting the object between a forward end and a rearward end of the tray, the upper surface having a lattice structure, a front support, connected to the forward end of the platform, having a first lower surface for receiving a first structure providing rotatable support to the drum, and at least one leg, connected to the rearward end of the platform, having a second lower structure for receiving a second structure providing rotatable support to the drum, and at least one handle provided with an opposing pair of openings formed in the platform, each opening having a gripping surface formed on an inner side surface, wherein the at least one handle is flush with the upper surface of the platform.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

First of all, a dryer rack according to the present invention can be installed in an exhaust type dryer, condensing type dryer, washer/dryer, or the like to use. In the exhaust type dryer, external air is heated to be supplied to a drum and humid air having dried a drying object within the drum is discharged outside. In the condensing type dryer, air, which is humid after having dried a drying object within a drum, is condensed by a condenser to lower humidity thereof and is then heated to be re-supplied to the drum. For convenience of explanation, a dryer rack according to the present invention installed in the exhaust type dryer is explained in the following description for example.

Figure 1:
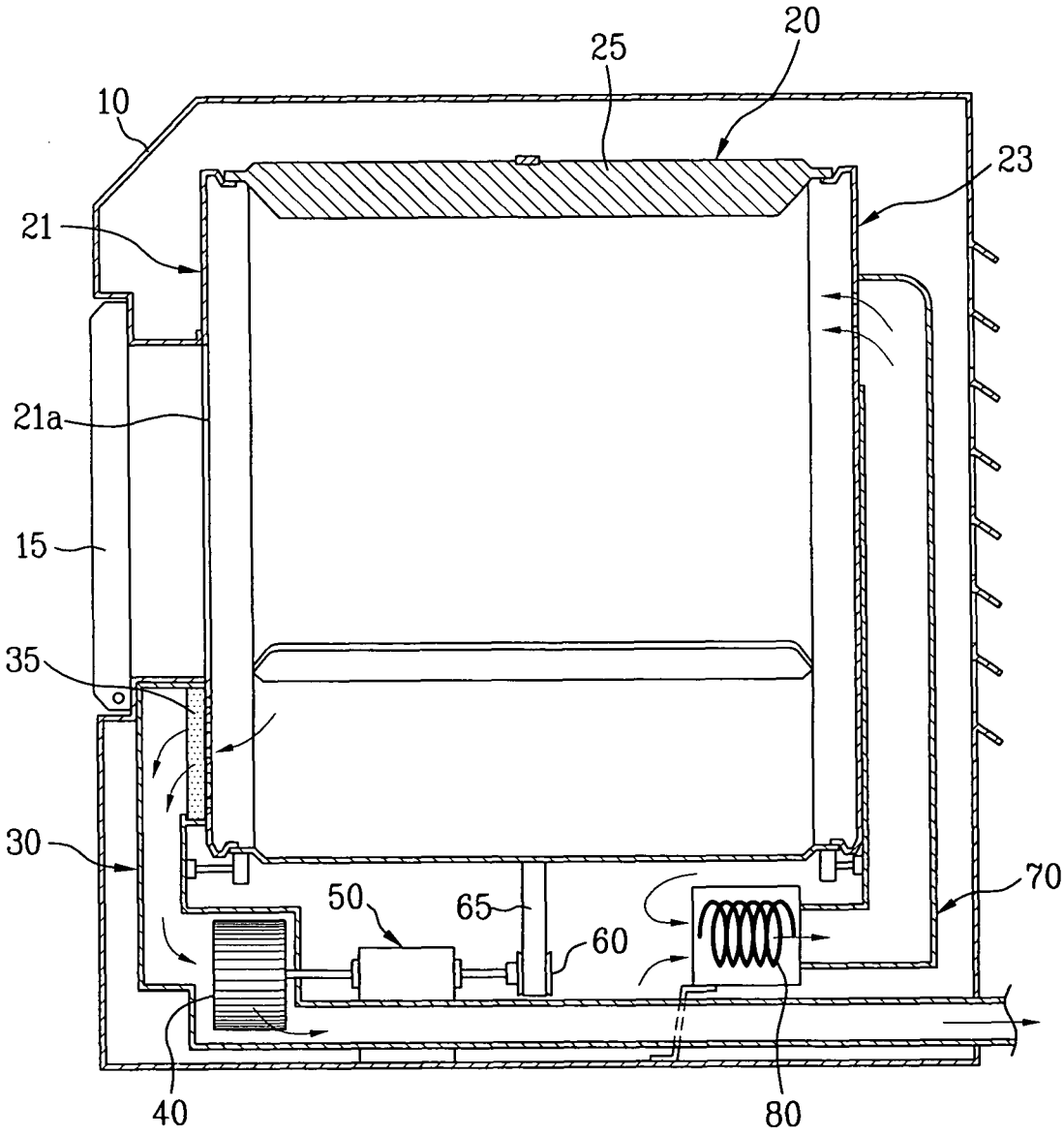
FIG. 1 is a cross-sectional diagram of an exhaust type dryer.

Referring to FIG. 1, a drum 20 is rotatably provided within a cabinet 10 of a dryer. The drum 20 has a cylindrical shape, and a plurality of lifters 25 protrude from an inside of the drum 20. The lifter 25 and the drum 20 are separately manufactured. Hence, the lifter 25 is attached to the inside of the drum 20 later. Instead, the lifters 25 may be built in one body of the drum 20. A front panel 21 and rear panel 23 are mounted on an open front side and open rear side of the drum 20 to rotatably support, respectively so that the drum 20 supported by the front and rear panels 21 and 23 can be rotated in operating the dryer. While the dryer is operated, the drum is rotated but the front and rear panels 21 and 23 are not rotated.

An opening 21*a* is provided to the front panel 21, and a door 15 is installed on the front side of the cabinet 10 to open/close the opening 21*a*. An exhaust duct 30 is connected to the front panel 21. Hence, an inside of the drum 20, as shown in FIG. 1, enables to communicate with an external environment outside the cabinet 10 via the exhaust due 30. Within the exhaust duct 30, a fan 40 blowing air in the drum 20 outside and a filter 35 filtering the air discharged outside by the fan 40 are provided. The fan 40, as shown in FIG. 1, is rotated by a motor 50 provided within the cabinet 10.

Meanwhile, the motor 50 may be provided to rotate the fan 40 only. Yet, in the drawing, the motor 50 is provided to rotate both of the fan 40 and the drum 20. For this, the motor 50 includes a pair of shafts connected to the fan 40 and a pulley 60, respectively. And, the pulley 60, is connected to the drum 20 via a belt 65. An air inlet duct 70 is connected to the rear panel 23 to enable the inside of the drum 20 to communicate with an external environment. As the fan 40 rotates to discharge the air within the drum 20 outside via the exhaust duct 30, external air is supplied into the drum 20 via the air inlet duct 70. Meanwhile, a heater 80, as shown in FIG. 1, is installed in the air inlet duct 70 to supply hot air into the drum 20.

Meanwhile, a dryer rack 100 according to the present invention is detachable installed in the drum 20 of the above-constructed dryer. The dryer rack 100 can be conveniently used in drying relatively heavy objects. The dryer rack 100 according to the present invention is explained in detail by referring to FIG. 2 and FIG. 3 as follows.

Figure 2:
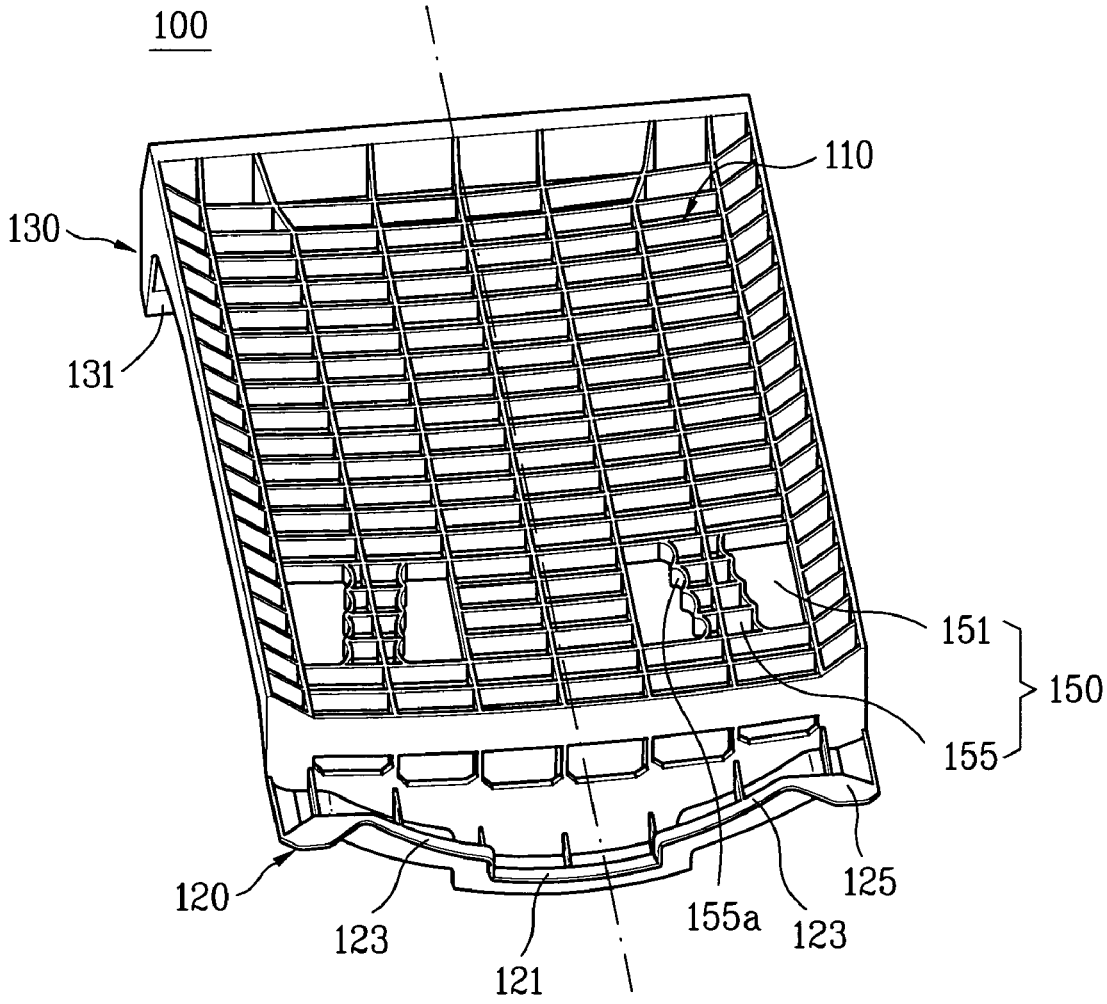
FIG. 2 is a perspective diagram of a dryer rack according to one embodiment of the present invention.
Figure 3:
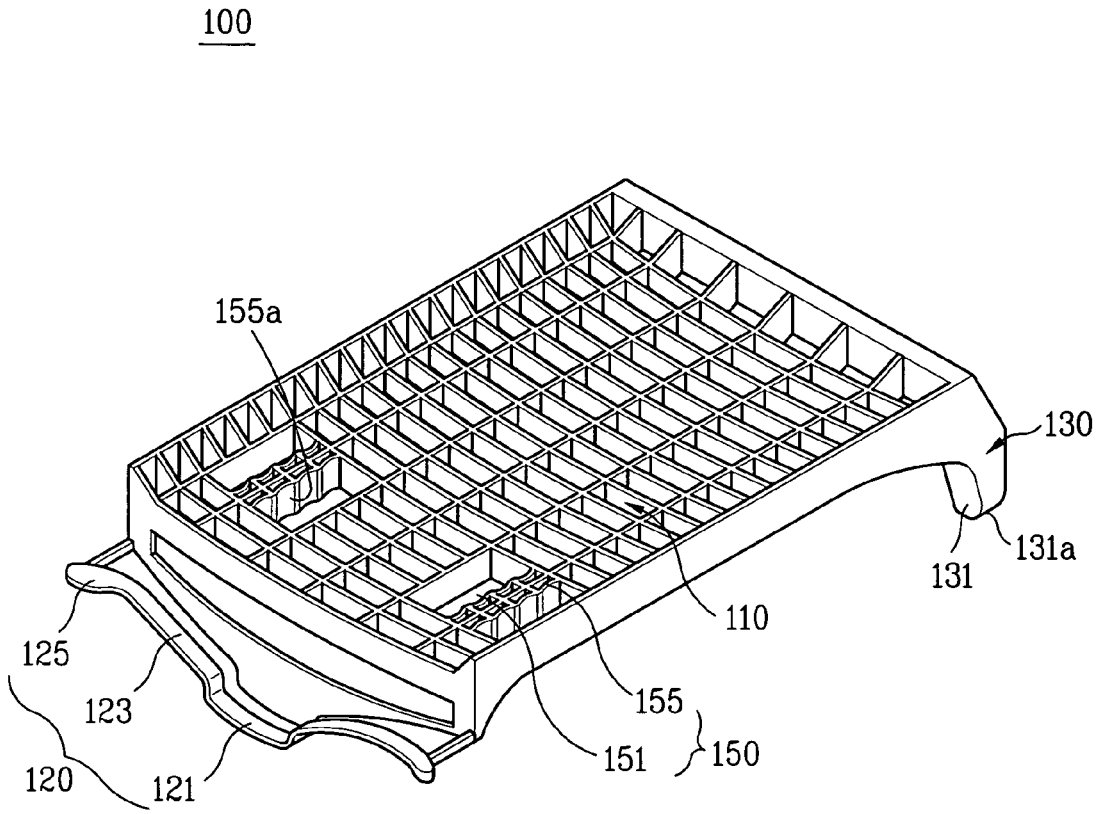
FIG. 3 is a perspective diagram of a dryer rack according to another embodiment of the present invention.

Referring to FIG. 2 and FIG. 3, a platform is provided to the dryer rack 100 to be detachably loaded in the drum 20 and to support a drying object thereon. A tray 110 having the drying object put thereon, a front support 120 extending from a front side of the tray 110, and a rear support 130 extending from a rear side of the tray 110 are provided to the body. The tray 110 may be constructed with a perforated panel so that air can pass through the platform or have lattice shape shown in FIG. 2. Hence, hot air supplied into the drum 20 can be smoothly provided to the drying object put on the tray 110, whereby drying efficiency is enhanced.

The front support 120 is supported by a structure fixed to an inner front side of the dryer or washer such as the front panel 21. And, the rear support 130 is supported by a structure fixed to an inner rear side of the dryer or washer such as the rear panel 23. Hence, when the dryer rack 100 is loaded in the drum 20, the tray 110 enables to maintain its position by the front and rear supports 120 and 130 without rotating within the drum 20. In loading the dryer rack 100 in or unloading out of the drum 20, the body, e.g., right and left sides of the tray 110, should be taken. Hence, the loading and unloading works are inconveniently performed.

Moreover, a size of the body, and more particularly, a right-to-left width of the tray 110, should be much smaller than a diameter of the opening 21*a*. If the right-to-left width of the tray 110 is too long, it is inconvenient for a user to install or uninstall the dryer rack 100. Besides, the user may be hurt by the opening 21*a*. Hence, at least one grip 150 is provided to the dryer rack 100 according to the present invention to overcome such a problem. The at least one grip 150 is provided to the body, and more particularly, to the tray 110 so that a user can conveniently hold it to load/unload the dryer rack 100 in/from the drum 20. The grip 150 is explained in detail by referring to FIG. 2 and FIG. 3 as follows.

Referring to FIG. 2 and FIG. 3, the at least one grip 150 if formed at the body, and more particularly, on such a plane as the tray 110. And, the at least one grip 150 includes a plurality of openings 151 and a grip 155. Specifically, a pair of openings 151, as shown in FIG. 2 and FIG. 3, are provided to the body, and more particularly, to the tray 110 to neighbor each other. And, the grip 155 lies on a boundary of the two neighboring openings 151 to be built in one body of the tray 110. Thus, if the grip 150 is provided to the tray 110, a user inserts his fingers in the openings 151 to grab the corresponding grip 155. The user then lifts the dryer rack 100 to install/uninstall in/from the drum 20.

Meanwhile, the grip 155 preferably includes a structure enabling user's fingers to closely adhere thereto. For this, outsides of the grip 155 are formed uneven or a multitude recesses 155*a* are formed on both lateral outsides of the grip 155. A pair of the openings 151 having user's fingers inserted therein may be symmetric or identical to each other in shape. Yet, the present invention does not put limitation of the shapes of the openings 151 that can be variously modified. For instance, when a user grabs the corresponding grip 155, user's thumb is inserted in one of the two neighbor openings 151 and the rest user's fingers are inserted in the other opening 151. Hence, a pair of the neighbor openings 151 can be differently shaped to be fit for the thumb and the reset fingers of the user, respectfully.

Meanwhile, in order to facilitate to install the dryer rack 100 in the drum 20, the grip 150, as shown in FIG. 2 and FIG. 3, is provided to a front part of the body, and more particularly, of the tray 110. Moreover, in order to facilitate a user to grab the grip 150 using both hands, a pair of the grips 155 are symmetrically provided to the front part of the tray 110. Furthermore, in order to facilitate a user to grab the grip 150 conveniently, the grip 155, as shown in FIG. 2, is tilted against a central axis in a length direction of the body, and more particularly, of the tray 110. In this case, the grip 155, as shown in FIG. 2, is tilted in a manner of extending from its rear part to its front part to get farther from the central axis. And, the corresponding tilted angle is about 10°~20°, and more preferably, about 15°.

Once the above-constructed grip is provided to the dryer rack 100, a user grabs the grip(s) 155 of the grip(s) 150 to load the dryer rack 100 in the drum 20 with ease. When the dryer rack 100 is loaded in the drum 20, the front and rear supports 120 and 130 are supported by immovable structures within the cabinet 10. Yet, in a drying operation, the drum 20 keeps rotating to generate vibration. Hence, the dryer rack 100 may fall down if failing to be securely loaded therein. Hence, the front and rear supports 120 and 130 include the structures for stable loading, respectively, which are explained in detail by referring to FIGS. 2 to 5 as follows.

Figure 4:
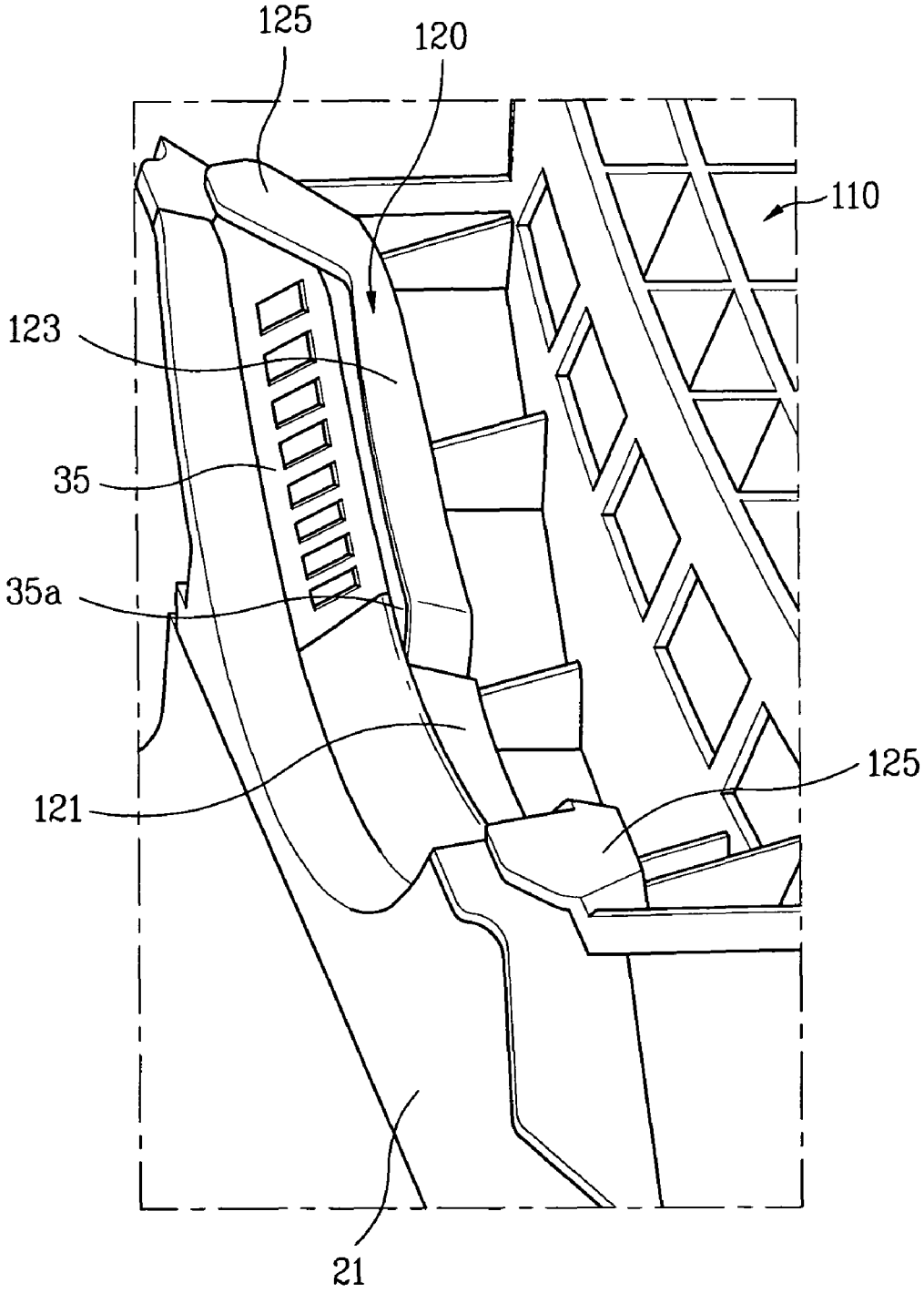
FIG. 4 is a perspective diagram of a front part of a dryer rack provided to a dryer according to the present invention.

First of all, the front support 120 can closely adhere to the front panel 21 in direct to be supported or to a topside of the filter 35 in FIG. 1 provided to the front side of the drum 20 for filter air discharged from the drum 20. Generally installed on the front panel 21, the filter 35 can be regarded as a part of the front panel 21. A curved portion 123, a projected portion 121, and a pair of end portions 125 are provided to the front support 120. For example, the curved portion 123, as shown in FIG. 2 and FIG. 3, is convex downward. And, the curved portion 123, as shown in FIG. 4, closely adheres to the topside of the filter 35. And, the projected portion 121, as shown in FIG. 2 and FIG. 3, is projected downward from a middle part of the curved portion 123. The projected portion 121, as shown in FIG. 4, is fitted in a recess 35*a* formed in the middle of the filter 35.

Moreover, a pair of the end portions 125, as shown in FIG. 2 and FIG. 3, are provided to both side ends of the curved portion 123. And, a pair of the end portions 125, as shown in FIG. 4, closely adhere to both ends of the topside of the filter 35 to be supported thereon, respectively. The end portions 125, as shown in FIGS. 2 to 4, protrude in a front direction. Meanwhile, the rear support 130 closely adheres to an inner circumference 23*a* of the rear panel 23 rotatably supporting the rear side of the drum 20 to be supported thereon. A pair of legs 131, as shown in FIG. 2, FIG. 3, and FIG. 5, protruding from the body, and more particularly, from both corners of a rear side of the tray 110 are provided to the rear support 130.

Figure 5:
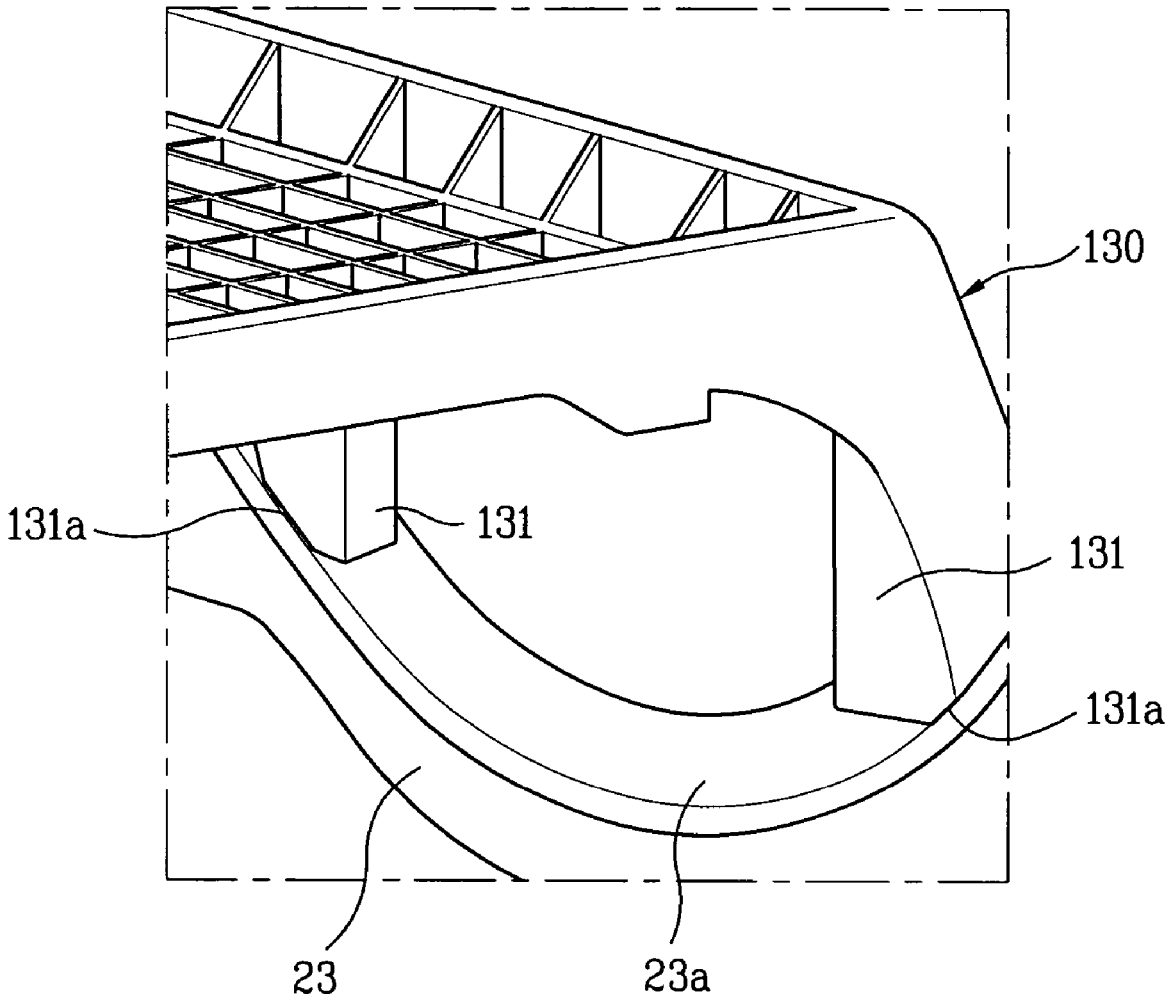
FIG. 5 is a perspective diagram of a rear part of a dryer rack provided to a dryer according to the present invention.

A pair of the legs 131, as shown in FIG. 5, are contacted with the inner circumference 23*a* of the rear panel 23 to closely adhere thereto. For this, a curved portion 131*a* having the same curvature of the inner circumference 23*a* of the rear panel 23 is provided to each lower part of the legs 131. As mentioned in the foregoing description of the present invention, the front support 120 closely adheres to a portion of the front panel 21, and more particularly, to the filter 35 to be supported thereon, and the rear support 130 closely adheres to the inner circumference 23*a* of the rear panel 23 to be supported thereon. Therefore, the dryer rack 100 installed in the drum 20 according to the present invention enables to maintain a stable loaded state even if vibration is generated from the drying operation.

A process of drying an object to be dried using the above-constructed dryer rack 100 according to the present invention is explained as follows. First of all, a user grabbing the grip 15 carries to load the dryer rack 100 in the drum 20. In doing so, user's hands are not exposed in both right and left directions of the dryer rack 100. Hence, the user enables to insert the dryer rack 100 in the drum 20 via the opening 21*a* conveniently even if the dryer rack 100 has a full-sized right-to-left width. Besides, since the grips 150 are provided to the front part of the dryer rack 10, the user just lays his hands on the grips 150 in the vicinity of the opening 21*a* conveniently. Once the dryer rack 100 is loaded in the drum 20, the user makes the rear support 130 closely adhere to the inner circumference 23*a* of the rear panel 23 to be supported thereon and also makes the front support 120 closely adhere to the portion of the front panel 21, e.g., the filter 35, to be supported thereon. After completion of loading the dryer rack 100 in the drum 20, a drying object is placed on the tray 110, the door is closed 15, and the dryer is then actuated.

Once the dryer is actuated, the drum 20 and fan 40 start to rotate as well as the heater 80 it turned on. Air within the drum 20 is then discharged outside via the exhaust duct 30 as well as hot air is supplied to the drum 20 via the air inlet duct 70. The hot air supplied to the drum 20 dries the drying object placed on the tray 110 of the dryer rack 100. In doing so, as the hot air passes through the tray 110 upward and downward, it is able to dry the drying object evenly. Besides, as the drying object stays onto the tray 110 of the dryer rack 100 during the drying process, noise and shock fail to occur within the drum 20.

The air, which becomes humid air after drying the drying object within the drum 20, is then discharged outside via the exhaust duct 30. In doing so, particles contained in the humid air are removed by the filter 35 so that clean air can be discharged outside only. Accordingly, the dryer rack according to the present invention facilitates to dry the relatively heavy drying object. It is a matter of course that the noise and shock caused by the fall of the drying object do not occur within the drum while the drying object is dried using the dryer rack. Therefore, the present invention enables to prevent the drum from being broken down and to secure the endurance of the drum.

And, the grips are provided to the dryer rack according to the present invention, thereby facilitating a user to load/unload the dryer rack in/from the drum. Moreover, the grips are tilted, thereby facilitating the user to grab the corresponding grips conveniently. Besides, there is a sufficient margin for designing the right-to-left width of the dryer rack, whereby a large amount of the drying object can be handled at the same time by the dryer. Furthermore, the dryer rack can be loaded/unloaded in/from the drum without danger of injury using the grips.

Moreover, the front and rear supports are provided to the front and rear sides of the dryer rack according to the present invention, respectively and are constructed to closely adhere to the structures supporting them. Therefore, even if vibration is generated from the drying operation, the dryer rack loaded in the drum does not move or rock side to side so that the drying object can be safely dried.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dryer rack for use with an apparatus for drying an object inside a drum, wherein the dryer rack supports the object being dried, the dryer rack comprising a platform having an upper surface and at least one grip having a pair of openings formed in the upper surface of the platform and a gripping structure positioned between the two openings, wherein the platform comprises the at least one grip and a second grip, symmetrically arranged about a central axis of the platform, for loading and unloading the dryer rack into an interior space of the drum.

2. The dryer rack as claimed in claim 1, wherein the gripping structure has a textured gripping surface.

3. The dryer rack as claimed in claim 1, wherein the at least one grip is flush with the upper surface of the platform.

4. The dryer rack as claimed in claim 1, wherein the at least one grip is formed in a front portion of the platform, to be near an access point of the drum.

5. The dryer rack as claimed in claim 2, wherein the textured gripping surface is formed on inner side surfaces on each opening.

6. The dryer rack as claimed in claim 1, wherein the grips are flush with the upper surface of the platform.

7. The dryer rack as claimed in claim 5, wherein the gripping surface comprises a set of curved recesses corresponding to digits of a human hand.

8. The dryer rack as claimed in claim 5, wherein the gripping surfaces of the opposing pair of openings are symmetrically arranged with respect to a centrally disposed handle.

9. The dryer rack as claimed in claim 5, wherein the gripping surfaces of the opposing pair of openings are asymmetrically arranged with respect to a centrally disposed handle.

10. The dryer rack as claimed in claim 9, wherein the asymmetrical arrangement of the gripping surfaces provides for a thumb and four fingers, respectively.

11. The dryer rack as claimed in claim 1, wherein the grips are formed in a front portion of the platform, to be near an access point of the drum.

12. The dryer rack as claimed in claim 1, wherein the grips are arranged at opposing angles for facilitating a two-handed grip when loading and unloading the dryer rack.

13. The dryer rack as claimed in claim 12, wherein the opposing angles are between 10° and 20°.

14. The dryer rack as claimed in claim 1, wherein the platform comprises:

a tray forming the upper surface between a front end and a rear end of the tray;

a front support connected to the front end of the tray which is supported by a first structure; and a rear support connected to the rear end of the tray which is supported by a second structure, wherein the first and second structures respectively provide rotatable support to opposite ends of the drum.

15. The dryer rack as claimed in claim 14, wherein the at least one grip is flush with the upper surface of the platform.

16. The dryer rack as claimed in claim 14, wherein the front and rear supports have lower surfaces for seating the dryer rack on the first and second structures.

17. The dryer rack as claimed in claim 16, wherein the lower surfaces of front and rear supports are shaped to avoid interference with the drum if the drum is rotated while the dryer rack is loaded into an interior space of the drum.

18. A dryer rack for use with an apparatus for drying an object inside a drum, wherein the dryer rack supports the object being dried, the dryer rack comprising:

a platform having an upper surface between a front end and a rear end of a tray, the upper surface having a lattice structure;

a front support connected to the front end of the platform having a first lower surface for receiving a first structure providing rotatable support to the drum; and at least one leg connected to the rear end of the platform having a second lower structure for receiving a second structure providing rotatable support to the drum; and at least one handle provided with an opposing pair of openings formed in the upper surface, each opening having a textured gripping surface formed on an inner side surface, wherein the at least one handle is flush with the upper surface of the platform.

19. A dryer rack for use with an apparatus for drying an object inside a drum, wherein the dryer rack supports the object being dried, the dryer rack comprising a platform having an upper surface and at least one grip having a pair of openings formed in the upper surface of the platform and a gripping structure positioned between the two openings, wherein the platform has a lattice structure.

20. A dryer rack for use with an apparatus for drying an object inside a drum, wherein the dryer rack supports an object being dried, the dryer rack comprising:

a tray having an upper surface between a front end and a rear end of the tray;

a front support connected to the front end of the tray having a first lower surface for receiving a first structure;

a rear support connected to the rear end of the tray having a second lower surface for receiving a second structure, wherein the first and second structures respectively provide rotatable support to opposite ends of the drum; and at least one grip having a pair of openings formed in the upper surface of the tray and a gripping structure positioned between the two openings.

21. The dryer rack as claimed in claim 20, wherein the front support rests on a filter installed in front of the drum, for filtering air expelled from the drum.

22. The dryer rack as claimed in claim 21, the front support comprising:

a pair of side extensions connected to the front end of the tray for supporting the dryer rack on the filter; and an arch stretching between the side extensions and extending downward for being seated on an upper surface of the filter having a centrally formed recess, the arch having an arch projection for insertion into the recess of the filter.

23. The dryer rack as claimed in claim 22, wherein the side extensions are disposed in front of the tray.

24. The dryer rack as claimed in claim 20, wherein the rear support comprises at least one leg connected to the rear end of the tray for supporting the dryer rack on the second structure.

25. The dryer rack as claimed in claim 24, wherein the second structure is a semicircle.

26. The dryer rack as claimed in claim 25, wherein the at least one leg has a curved lower surface for being seated on the semicircle of the second structure.

27. The dryer rack as claimed in claim 20, wherein the rear support comprises at least two legs connected to the rear end of the tray for supporting the dryer rack on the second structure, the at least two legs have opposingly curved surfaces for being respectively seated on a semicircle of the second structure.

28. The dryer rack as claimed in claim 20, wherein the at least one grip is formed in the upper surface of the tray for loading and unloading the dryer rack into an interior space of the drum.

29. The dryer rack as claimed in claim 20, wherein the gripping structure has a textured gripping surface.

30. The dryer rack as claimed in claim 29, wherein the textured gripping surface is formed on inner side surfaces on each opening.

31. The dryer rack as claimed in claim 29, wherein the gripping surface comprises a set of curved recesses corresponding to digits of a human hand.

32. The dryer rack as claimed in claim 30, wherein the gripping surfaces of the opposing pair of openings are symmetrically arranged with respect to a centrally disposed handle.

33. The dryer rack as claimed in claim 30, wherein the gripping surfaces of the opposing pair of openings are asymmetrically arranged with respect to a centrally disposed handle.

34. The dryer rack as claimed in claim 33, wherein the asymmetrical arrangement of the gripping surfaces provides for a thumb and four fingers, respectively.

* * * * *